US009212543B2

(12) United States Patent
Stormoen et al.

(10) Patent No.: US 9,212,543 B2
(45) Date of Patent: Dec. 15, 2015

(54) APPARATUS AND METHODS FOR CONDUCTING WELL-RELATED FLUIDS

(71) Applicants: Kent W. Stormoen, Alberta, CA (US); David G. Speed, Flower Mound, TX (US)

(72) Inventors: Kent W. Stormoen, Alberta, CA (US); David G. Speed, Flower Mound, TX (US)

(73) Assignee: Maximum Erosion Mitigation Systems Ltd., Sylvan Lake (CA)

( * ) Notice: Subject to any disclaimer, the term of this patent is extended or adjusted under 35 U.S.C. 154(b) by 393 days.

(21) Appl. No.: 13/757,652

(22) Filed: Feb. 1, 2013

(65) Prior Publication Data

US 2014/0216750 A1 Aug. 7, 2014

(51) Int. Cl.
*E21B 43/12* (2006.01)
*E21B 43/26* (2006.01)

(52) U.S. Cl.
CPC ..... *E21B 43/12* (2013.01); *E21B 43/26* (2013.01)

(58) Field of Classification Search
CPC ..... E21B 43/12; E21B 43/26
See application file for complete search history.

(56) References Cited

U.S. PATENT DOCUMENTS

| | | | | |
|---|---|---|---|---|
| 4,588,509 | A | 5/1986 | Hyde et al. | 210/788 |
| 5,513,704 | A | 5/1996 | Sander | 166/91.1 |
| 6,973,974 | B2 | 12/2005 | McLoughlin et al. | 166/386 |
| 7,175,748 | B2 | 2/2007 | Michaelsen et al. | 204/547 |
| 7,575,058 | B2 | 8/2009 | Franco et al. | 166/334.4 |
| 7,621,324 | B2 | 11/2009 | Atencio | 166/250.15 |
| 7,730,948 | B2 | 6/2010 | De Grood et al. | 166/280.2 |
| 7,779,920 | B2 | 8/2010 | Eriksen et al. | 166/377 |
| 8,127,867 | B1 | 3/2012 | Droke | 175/206 |
| 8,186,444 | B2 | 5/2012 | Patel | 166/373 |
| 8,286,715 | B2 | 10/2012 | Bailey et al. | 166/380 |
| 2007/0029090 | A1 | 2/2007 | Andreychuk et al. | 166/308.1 |
| 2010/0206560 | A1 | 8/2010 | Atencio | 166/250.15 |
| 2011/0048695 | A1* | 3/2011 | Cherewyk et al. | 166/90.1 |
| 2011/0074150 | A1* | 3/2011 | Drost et al. | 285/363 |
| 2011/0259584 | A1 | 10/2011 | Broussard, II | 166/271 |
| 2014/0151065 | A1* | 6/2014 | Stephenson et al. | 166/374 |

OTHER PUBLICATIONS

Browne, D.J. et al., "Proppant Flowback Control in Deviated Shallow Gas Wells," *Canadian International Petroleum Conference* 2001-106; 2001.

All Consulting, LLC, *The Modern Practices of Hydraulic Fracturing: A Focus on Canadian Resources*; Jun. 2012.

Canadian Society for Unconventional Gas, *Understanding Hydraulic Fracturing*; 2011.

Environmental Tank & Container, *Flowback/Gasbuster Tank*, http://www.etctank.com/print/ETC_Flowback_Flyer.pdf. Retrieved Jan. 8, 2013.

* cited by examiner

*Primary Examiner* — William P Neuder
(74) *Attorney, Agent, or Firm* — Norton Rose Fulbright US LLP

(57) ABSTRACT

Apparatus and methods for conducting well-related fluids are disclosed. The apparatus and methods may be used to mitigate erosion of fluid handling equipment by fluids associated with hydrocarbon wells. An exemplary apparatus comprises: an upstream conduit including an upstream fluid passage for receiving and conducting well-related fluid; a choke member including a choke fluid passage; and a downstream conduit including a downstream fluid passage in fluid communication with the upstream fluid passage via the choke fluid passage. A cross-sectional area of the downstream passage may be greater than a cross-sectional area of the upstream passage to allow expansion of the fluids passing through the choke such that the average velocity of such fluids may not exceed a threshold velocity selected to mitigate erosion of the downstream conduit.

16 Claims, 6 Drawing Sheets

APPARATUS AND METHODS FOR CONDUCTING WELL-RELATED FLUIDS

TECHNICAL FIELD

The disclosure relates generally to the handling of well-related fluids and more particularly to mitigating erosion of fluid handling equipment by well-related fluids.

BACKGROUND OF THE ART

Hydraulic fracturing operations are used to improve the flow of hydrocarbons from subterranean formations and into a wellbores. Fracturing involves pumping of a fracturing fluid into the wellbore under extremely high pressure in order to induce fracturing in the formation rock immediately surrounding the wellbore to improve the transmission of hydrocarbons through the formation and into the wellbore. Proppants are often included in the fracturing fluid to penetrate the fractures created in the formation by the fracturing fluid and effectively prop the fractures open after the pressure is removed.

During or after hydraulic fracturing, cleaning and other operations related to the preparation of the oil or gas wells for long term production can include pressurized fluid(s) (materials) flowing back from the wells. Such flow back fluids may include a mixture of water, gas, oil, sand, solid rocks or other solids, completion fluid and drilling mud for example. Such flow back fluids can be abrasive and can cause erosion of existing fluid equipment. Existing equipment for handling such fluids must be monitored closely to prevent potentially catastrophic failures of such equipment due to erosion.

Improvement is therefore desirable.

SUMMARY

The disclosure describes an apparatus for conducting well-related fluid, the apparatus comprising: an upstream conduit including an upstream fluid passage for receiving and conducting well-related fluid, the upstream fluid passage being defined by a fluid passage-defining upstream conduit surface material and having an upstream cross-sectional area at an upstream location; a choke member including a choke fluid passage in fluid communication with the upstream fluid passage, the choke fluid passage being defined by a fluid passage-defining choke member surface material, the choke fluid passage having a choke inlet, for receiving the well-related fluid from the upstream fluid passage, and a choke outlet, the choke fluid passage having a minimum choke cross-sectional area that is smaller than the upstream cross-sectional area; and a downstream conduit including a downstream fluid passage in fluid communication with the upstream fluid passage via the choke fluid passage and configured to receive the well-related fluid from the choke outlet and conduct the well-related fluid, the downstream fluid passage being defined by a fluid passage-defining downstream conduit surface material and having a downstream cross-sectional area at, or substantially at the choke outlet, or disposed within six (6) inches of the choke outlet, wherein the downstream cross-sectional area is larger than the upstream cross-sectional area; wherein the wear resistance of the fluid passage-defining choke member surface material is greater than the wear resistance of the fluid passage-defining downstream conduit surface material.

In another aspect, there is provided an assembly for conducting well-related fluid, the assembly comprising: an upstream conduit including an upstream fluid passage defined therein for receiving and conducting well-related fluid, the upstream fluid passage having an upstream cross-sectional area at an upstream location; a removably installed choke member including a choke fluid passage defined therein, the choke fluid passage having a choke inlet, for receiving the well-related fluid from the upstream fluid passage, and a choke outlet, the choke fluid passage having a minimum choke cross-sectional area that is smaller than the upstream cross-sectional area; and a downstream conduit including a downstream fluid passage defined therein in fluid communication with the upstream fluid passage via the choke fluid passage and configured to receive the well-related fluid from the choke outlet and conduct the well-related fluid, the downstream fluid passage having a downstream cross-sectional area at, or substantially at, the choke outlet, or disposed within six (6) inches of the choke outlet, that is larger than the upstream cross-sectional area.

In a further aspect, there is provided an apparatus for conducting well-related fluid, the apparatus comprising: a first choke member including a first choke fluid passage defined therein, the first choke fluid passage being configured to receive a pressurized well-related fluid and cause a first pressure drop in the well-related fluid; and a first conduit including a first fluid passage defined therein, the first fluid passage having a first introduction region configured to receive the well-related fluid from the first choke fluid passage and conduct well-related fluid toward a container, the first fluid passage having a first cross-sectional area at the first introduction region that is sized based on: a predetermined flow rate of well-related fluid through the first fluid passage; a predetermined pressure of the well-related fluid in the first fluid passage; a predetermined portion of the well-related fluid being compressible and a first threshold average fluid velocity through the first fluid passage selected to mitigate erosion.

In another aspect, there is provided a method for conducting compressible well-related fluid toward a container, the method comprising: receiving a flow of pressurized compressible well-related fluid; reducing a pressure of the compressible well-related fluid; allowing the compressible well-related fluid to expand immediately after the reduction in pressure of the compressible well-related fluid, the expansion of the compressible well-related fluid being based on: a predetermined flow rate of the compressible well-related fluid; a predetermined pressure of the expanded compressible well-related fluid; a predetermined portion of the compressible well-related fluid being compressible and a threshold average fluid velocity selected to mitigate erosion of the fluid handling equipment; and conducting the expanded compressible well-related fluid toward a container at an average velocity that is below the predetermined threshold average fluid velocity.

In another aspect, there is provided a method for conducting compressible well-related fluid, the method comprising: receiving a flow of pressurized compressible well-related fluid within a choke, the choke including a choke fluid passage having a minimum choke cross-sectional area; reducing a pressure of the compressible well-related fluid within the choke fluid passage sufficiently to effect expansion of the compressible well-related fluid, such that the effected reduction in pressure is at least a twenty (20) percent pressure reduction; discharging the depressurized compressible well-related fluid from an outlet of the choke into a downstream conduit including a downstream fluid passage in fluid communication with the choke fluid passage and configured to receive the well-related fluid from the choke outlet and conduct the well-related fluid, the downstream fluid passage having a downstream cross-sectional area at, or substantially at, the choke outlet, or disposed within six (6) inches of the choke outlet, wherein the downstream cross-sectional area is larger than a cross-sectional area of an upstream fluid passage through which the pressurized compressible well-related fluid is flowed at an upstream location, upstream of the choke.

In another aspect, there is provided an assembly for conducting well-related fluid, the assembly comprising: an upstream conduit including an upstream fluid passage defined therein for receiving and conducting well-related fluid, the upstream fluid passage having an upstream cross-sectional area at an upstream location; a choke member including a choke fluid passage defined therein, the choke fluid passage having a choke inlet, for receiving the well-related fluid from the upstream fluid passage, and a choke outlet, the choke fluid passage having a minimum choke cross-sectional area that is smaller than the upstream cross-sectional area, the choke member characterized by a friction loss coefficient ($K_f$) of at least 15; and a downstream conduit including a downstream fluid passage defined therein in fluid communication with the upstream fluid passage via the choke fluid passage and configured to receive the well-related fluid from the choke outlet and conduct the well-related fluid, the downstream fluid passage having a downstream cross-sectional area at, or substantially at, the choke outlet, or disposed within six (6) inches of the choke outlet, that is larger than the upstream cross-sectional area.

In a further aspect, there is provided an assembly for conducting well-related fluid, the assembly comprising: a choke member including a choke fluid passage defined therein, the choke fluid passage having a choke inlet, for receiving the well-related fluid from the upstream fluid passage, and a choke outlet, the choke fluid passage having a minimum choke cross-sectional area; an upstream pipe connected to the choke member, upstream of the choke member, the upstream pipe including an upstream fluid passage defined therein for receiving and conducting well-related fluid, the upstream fluid passage having an upstream cross-sectional area at an upstream location; and a downstream pipe connected to the choke member, downstream of the choke member, the downstream pipe including a downstream fluid passage defined therein in fluid communication with the upstream fluid passage via the choke fluid passage, the downstream fluid passage being configured to receive the well-related fluid from the choke outlet and conduct the well-related fluid, the downstream fluid passage having a downstream cross-sectional area at a downstream location that is larger than the upstream cross-sectional area.

In a further aspect, there is provided an assembly for conducting well-related fluid, the assembly comprising: a choke member including a choke fluid passage defined therein, the choke fluid passage having a choke inlet, for receiving the well-related fluid from the upstream fluid passage, and a choke outlet, the choke fluid passage having a minimum choke cross-sectional area; an upstream pipe connected to the choke member, upstream of the choke member, the upstream pipe including an upstream fluid passage defined therein for receiving and conducting well-related fluid, the upstream fluid passage having an upstream cross-sectional area at an upstream location; an expander connected to the choke member, downstream of the choke member; and a downstream pipe connected to the choke member, downstream of the choke member, via the expander, the downstream pipe including a downstream fluid passage defined therein in fluid communication with the upstream fluid passage via the choke fluid passage, the downstream fluid passage being configured to receive the well-related fluid from the choke outlet and conduct the well-related fluid, the downstream fluid passage having a downstream cross-sectional area at a downstream location that is larger than the upstream cross-sectional area.

Further details of these and other aspects of the subject matter of this application will be apparent from the detailed description and drawings included below.

DESCRIPTION OF THE DRAWINGS

Reference is now made to the accompanying drawings, in which.

DETAILED DESCRIPTION

Aspects of various embodiments are described through reference to the drawings.

Figure 1:
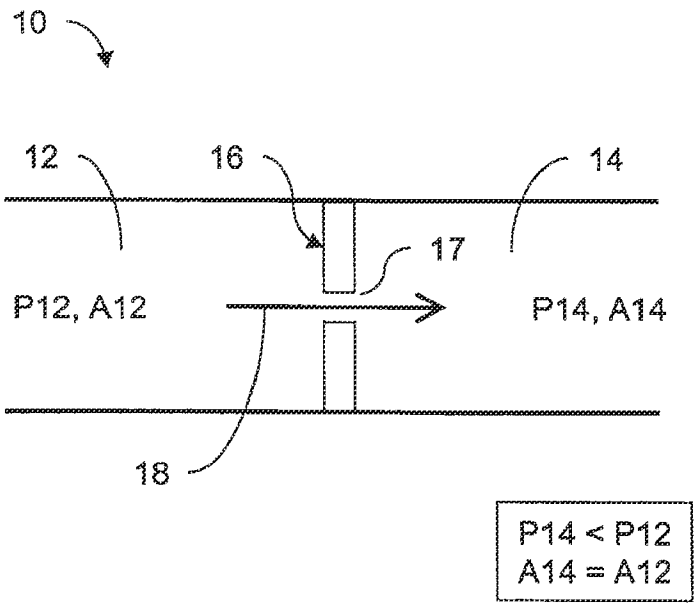
FIG. 1 (PRIOR ART)
FIG. 1 is a schematic representation of a fluid conducting apparatus including a choke according to the prior art.

FIG. 1 shows a fluid conducting apparatus, generally shown at 10, according to the prior art. Fluid conducting apparatus 10 comprises a conduit having upstream portion 12 and downstream portion 14. Upstream portion 12 and downstream portion 14 have substantially equal cross-sectional areas, respectively shown at 12 and 14. Fluid conducting apparatus 10 also comprises choke 16 defining choke fluid passage 17. Upstream portion 12 and downstream portion 14 are in fluid communication via choke fluid passage 17. The use of chokes for restricting fluid flow is known. The flow-restricting function of chokes can cause an associated pressure (i.e., head) loss in a fluid flowing through choke fluid passage 17. For example, as a fluid flows from upstream portion 12, through choke fluid passage 17 along arrow 18, and into downstream portion 14, choke 16 causes a pressure drop in the fluid. Accordingly, fluid pressure P14 in downstream portion 14 is lower than fluid pressure P12 in upstream portion 12.

When the fluid passing through choke 16 is compressible, such drop in pressure can result in expansion of the fluid. For a gaseous (e.g., compressible) portion of such fluid, the magnitude expansion of the fluid can be a function of the drop in pressure of the fluid. For example, the expansion of a gaseous portion of a fluid may be proportional to the drop in pressure and may be estimated using Boyle's law; P1*V1=P2*V2, where P1 and V1 are a first pressure and corresponding first volume respectively of a gas and P2 and V2 are a second pressure and corresponding second volume respectively of the gas. Hence, since the pressure drop across choke 16 causes an expansion of compressible phase(s) in fluid in downstream portion 14 and the cross-sectional area 14 of downstream portion 14 is equal to the cross-sectional area 12 of upstream portion 12, the expansion of the fluid will cause a corresponding increase in velocity of the fluid. Accordingly, the velocity of the fluid will be higher in downstream portion 14 than in upstream portion 12 in the event where the pressure drop caused by choke 16 results in an expansion of the fluid.

During well-related applications involving flow back of well-related fluids, the flow back fluids can be pressurized to high pressures such as 10 ksi (kilopounds per square inch) and these pressures must be reduced before the fluids can be sent to the container(s) at atmospheric pressures. Some well-related fluids such as flow back fluids can be multi-phase fluids that may, for example contain gaseous phases (e.g., natural gas), liquid phases (e.g., water), drilling mud, sand and/or proppant used in hydraulic fracturing processes. Accordingly, such well-related fluids can be abrasive and can cause erosion of fluid handling equipment. Pipe erosion, when started can be considered by most as being similar to tooth decay. Once a path of erosion has started it can tend to continue vigorously.

If fluid conducting apparatus 10 is used to cause a decrease in pressure of well-related fluids during a flow back operation, the pressure drop can cause the fluids to expand and thereby cause the velocity of the fluid to increase in downstream portion 14 and consequently increase the risk of erosion in downstream portion 14 in relation to upstream portion 12. Depending on the magnitude of the pressure drop, the flow rate of fluid(s) and also the portion of the fluid being compressible, the increase in velocity and corresponding risk of erosion of downstream portion 14 and any downstream fluid handling equipment can be significant.

Solid particles such as those that may be found in well-related fluids in combination with high velocity, friction and turbulence can increase the risk of erosion in fluid handling equipment. It has been determined that in oilfield applications where solids in the form of drilling mud, sand (e.g., propant) or any produced or drilled solids will erode fluid handling equipment such as piping. For example, erosion can be more severe when fluid velocities exceed 120 ft/s. It can be difficult some cases to reduce the velocity of well-related fluids using standard oilfield practices and equipment and keep velocities at safe levels where erosion is mitigated. This is especially true when compressible gas is a part of the multi-phase fluid stream because of the expansion of compressible phase(s) when the pressure of the fluid(s) is decreased such as in downstream portion 14 for example.

When a choke 16 (e.g. flow restriction) is utilized there can be a pluming effect as the fluid(s) exit the choke 16 and enter outlet 14 from the rapid-transition of upstream pressure P12 to the downstream pressure P14. This effect can be compounded by the extreme turbulence of the sheering effect of the fluid(s) going through the choke 16. The pluming effect can encounter the internal walls outlet 14 on the downstream side of choke 16 and result in erosion starting immediately downstream of the choke 16. Most failures due to erosion (e.g., wash outs and loss of containment) can occur directly downstream of choke 16.

Figure 2:
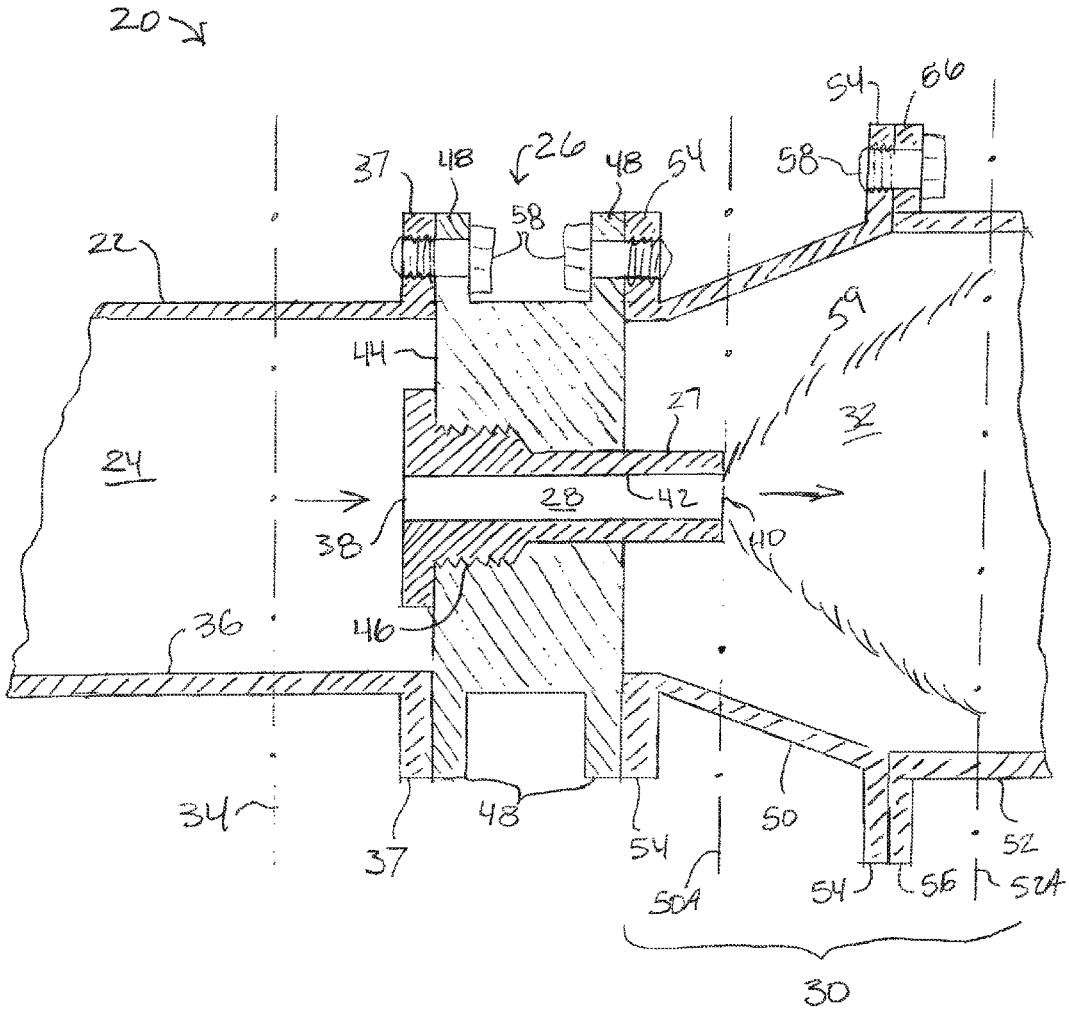
FIG. 2 is an axial cross-sectional view of an exemplary fluid conducting apparatus in accordance with the present disclosure.

FIG. 2 shows an axial cross-sectional view of an exemplary fluid conducting apparatus 20 in accordance with the present disclosure. Apparatus 20 may be used in well-related applications for conducting multi-phase, well-related fluids such as flow back fluids that may be at least partially compressible. For example, apparatus 20 may be used in operations associated with hydraulic fracturing of hydrocarbon wells. During hydraulic fracturing operations, a well undergoing hydraulic fracturing can become plugged with sand (proppant) that is injected into the well to prop the fractures open when the pressure of the fracturing fluid is released following a hydraulic fracturing operation. In such occurrances, a clear-out operation must be conducted on the well to unplug the well. Such clear-out operations can result in high pressure fluid(s) and relatively large amounts of sand flowing back from the well. The fluids including the sand are collected in one or more flow back tanks open to the atmosphere. However, the pressure of the flow back fluid(s) must be reduced prior to collection in the flow back tank(s).

Fluid conducting apparatus 20 may be used to mitigate erosion of fluid conducting equipments during operations. For example fluid conducting apparatus 20 may be used to control the velocity of such fluids in fluid handling equipment such that the average velocity of such fluids may not exceed a threshold velocity selected to mitigate erosion. The term "average velocity" through a conduit is used herein as representing the volumetric flowrate divided by the cross-sectional area of the conduit.

Fluid conducting apparatus 20 may comprise upstream conduit(s) 22 defining upstream fluid passage(s) 24 for receiving and conducting well-related fluid(s); choke(s) 26 including choke member(s) 27 defining choke fluid passage(s) 28; and downstream conduit(s) 30 defining downstream fluid passage(s) 32. Upstream fluid passage 24 may have an upstream cross-sectional area taken, for example, at location 34 along upstream fluid passage 24 and transverse to upstream fluid passage 24. Upstream conduit 22 may comprise a pipe of uniform diameter and internal cross-sectional area along its length. Upstream fluid passage 24 may have a substantially uniform cross-sectional area. The upstream cross-sectional area may be a maximum cross-sectional area, and the maximum cross-sectional area may be disposed at one or more locations along its length. The upstream cross-sectional area may also be taken at, or substantially at, the choke inlet (such as at location 34). The upstream cross-sectional area may also be taken within an operative distance of six (6) inches of the choke inlet, measured along the axis of the flow passage. For example, the operative distance is three (3) inches. As a further example, the operative distance is one (1) inch. Upstream fluid passage 24 may be defined by interior wall(s) 36 of upstream conduit 22. Upstream conduit 22 may be configured for fluid connection to a hydrocarbon well and accordingly may receive well-related fluid(s) (e.g., flow back fluids) during well-related operations. For example, upstream conduit 22 may comprise flange(s) 37 for removably coupling upstream conduit 22 to other fluid handling equipment.

Choke member 27 may include a conventional or other type of flow bean. Alternatively, choke 26 my be of other suitable type of choke (e.g., choke plate) suitable for use in conjunction with well-related fluid(s). Choke fluid passage 28 may have choke inlet(s) 38 for receiving well-related fluid(s) from upstream fluid passage 24 and choke outlet(s) 40. Choke fluid passage 24 may be defined by interior wall(s) 42 of choke member 26.

Choke fluid passage 28 may have a minimum choke cross-sectional area that is smaller than the upstream cross-sectional area. Accordingly, choke fluid passage 28 may serve as a flow restriction and cause a pressure drop in the well-related fluid(s) flowing therethrough. Since the average flow velocity of well-related fluid(s) through choke fluid passage 28 may be higher than the average flow velocity of well-related fluid(s) through upstream fluid passage 24, choke member 27 may be made of a material having a wear resistance that is higher than upstream conduit 22 and/or downstream 24. Accordingly, interior wall(s) 42 of choke member 27 may comprise a material having a higher wear resistance than a material comprised in interior wall(s) 36 of upstream conduit 22. The comparison of wear resistance may be done in accordance with standard testing procedures such as defined by applicable standards from ASTM International. For example, the difference in wear resistance may be defined by an amount of material removal during a specified time period under well-defined testing conditions. Choke member 27 may be a distinct and replaceable component made of a different material than upstream conduit 22 and/or downstream conduit 30. For example, choke member 27 may comprise a material having a hardness higher than the material of upstream conduit 22 and/or downstream conduit 30. For example choke member 27 may comprise tungsten carbide or ceramic, and conduits 24 and 30 may comprise carbon steel, A105B carbon steel (sour service), A333 carbon steel (sour service), 4130 pipe or 4140 pipe.

Choke 26 may comprise choke body(ies) 44 to which choke member 27 may be removably installed to establish fluid communication between upstream fluid passage 24 and downstream fluid passage 32. For example, choke member 27 may be threadably secured to choke body 44 via threads 46. Accordingly, choke member 27 may be removably secured to choke body 44 and may be replaceable. For example, choke member 27 may be replaced in case of wear (e.g., due to erosion) or if another choke member 27 having a different minimum choke cross-sectional area is desired instead (e.g., if the flow resistance offered by choke member 27 is to be changed). Choke 26 may also comprise flange(s) 48 removably coupling choke 26 to other fluid handling equipment. For example, flanges 48 may be used to removably couple choke 26 to upstream conduit 22 and also to removably couple choke 26 to downstream conduit 30.

Downstream conduit 30 may comprise adaptor(s) 50 and downstream pipe(s) 52. Downstream pipe 52 may have a substantially uniform diameter and internal cross-sectional area along its length. Together, adaptor 50 and downstream pipe 52 may define downstream fluid passage 32. Downstream fluid passage 32 may be in fluid communication with upstream fluid passage 24 via choke fluid passage 28 and configured to receive well-related fluid(s) from choke outlet 40 and conduct the well-related fluid. Downstream pipe 52 may conduct well-related fluid(s) to a container described further below in relation to FIGS. 3, 4 and 5). Adaptor 50 may comprise flanges 54 that may be used to removably couple adaptor 50 to other fluid handling equipment. For example, flanges may be used to removably couple adaptor 50 to choke 26 and/or to downstream pipe 52. Similarly, downstream pipe 52 may comprise flanges 56 that may be used to removably couple downstream pipe 52 to other fluid handling equipment such as adaptor 50.

Downstream fluid passage 32 may have an introduction region at or near position 50A within which well-related fluid(s) may be introduced into downstream fluid passage 32. For example, choke member 27 may partially extend into downstream conduit 30 up to position 50A. Potentially varying with the position at which the cross-sectional area is taken, the cross-sectional area within the downstream fluid passage 32 is larger than the minimum choke cross-sectional area by a factor of at least two (2). For example, the factor is at least three (3).

A cross-sectional area of downstream fluid passage 32 at position 50A (e.g., at the introduction region), where choke outlet 40 is positioned, may be larger than the upstream cross-sectional area of upstream fluid passage 24 taken at position 34, which may be near or at choke inlet 38. Position 50A may, in some embodiments, be at, or substantially at, the choke outlet 40. A cross-sectional area of downstream fluid passage 32, taken within an operative distance of six (6) inches of the choke outlet 40, measured along the axis of the downstream fluid passage 32, is also larger than the upstream cross-sectional area of upstream fluid passage 24, taken at, or near, the choke inlet 38. In some embodiments, for example, the operative distance is three (3) inches. In some embodiments, for example, the operative distance is one (1) inch. For example, a cross-sectional area of downstream fluid passage 32 at position 50 may also be larger than the upstream cross-sectional area of upstream fluid passage 24 taken at, or near, the choke inlet 38. As a further example, a cross-sectional area of downstream fluid passage 32 at position 52A (e.g., at downstream pipe 52) may also be larger than the upstream cross-sectional area of upstream fluid passage 24 taken at, or near, the choke inlet. Potentially varying with the positions at which the upstream and downstream cross-sectional areas are taken, the cross-sectional area of the downstream fluid passage is larger than the cross-sectional area of the upstream fluid passage by a factor of at least 1.1. For example, the factor is at least 1.2. As a further example, the factor is at least 1.25. As yet a further example, the factor is at least 1.5 As a further example, the factor is at least two (2).

For example, choke 26 may be adapted to be coupled to an upstream pipe having an outside diameter of 2 inches and to a downstream pipe having an outside diameter of 3 inches. Choke 26 may be adapted to be coupled to an upstream pipe having an outside diameter of 2 inches and to a downstream pipe having an outside diameter of 3 inches. Alternatively, choke 26 may be adapted to be coupled to an upstream pipe having an outside diameter of 2 inches and to a downstream pipe having an outside diameter of 6 inches. In light of the present disclosure, one skilled in the relevant arts will understand that the choke 26 could also be configured to be coupled to pipes of other sizes.

Downstream pipe 52 may have a substantially uniform cross-sectional area along a length of downstream pipe 52. Accordingly, downstream passage 32 may have a substantially uniform cross-sectional area along the length of downstream pipe 52. Downstream pipe 52 conduct de-pressurized well-related fluid(s) to a container which may be at atmospheric pressure.

Choke 26 may be configured to be removably coupled to (e.g. installed between) upstream and downstream conduits of the same or similar sizes so adaptor 50 may be used to adapt a downstream interface of choke 26 to downstream pipe 52, which may be of a larger size (e.g., diameter) than upstream conduit 22. Alternatively, if the downstream interface of choke 26 is configured to be coupled directly to downstream pipe 52, then adaptor 50 may not be required. In any event, choke 26 may be removably coupled to upstream conduit 22 using flanges 37 and 48 and bolts 58 or other suitable fastener(s). Similarly, choke 26 may be removably coupled to downstream conduit 30 using flanges 48 and 54 and bolts 58 or other suitable fastener(s). Accordingly, choke 26 may be removably installed in fluid conducting apparatus 20 and thereby permit replacement of choke member 27 (e.g., choke bean or insert). Also adaptor 50 may be removably coupled to downstream pipe 52 using flanges 54 and 56 and bolts 58 or other suitable fastener(s). A plurality of bolts 58 may be circumferentially distributed about flanges 37, 48, 54 and 56. Suitable sealing means (not shown) may be provided to substantially prevent leakage of well-related fluid(s) between the fluid handling components. For example sealing members (e.g., compressible seal, gasket) (not shown) may be provided between flanges 37 and 48; between flanges 48 and 54; and, between flanges 54 and 56 to substantially prevent leakage.

In light of the present disclosure, one skilled in the relevant arts will understand that other means of removably installing choke 26 and establishing fluid communication between upstream passage 24, choke 26 and downstream passage 32 could be used instead or in addition to flanges 37, 48, 54, 56 and bolts 58. For example, suitable threaded pipe fittings 61 as illustrated in FIG. 3 could be used for removably coupling various components of fluid conducting apparatus 20 and manifold 60 also illustrated in FIG. 3.

Adaptor 50 may provide a gradual expansion of downstream fluid passage 32 between choke body 44 and downstream pipe 52. Accordingly, cross-sectional area of downstream fluid passage 32 at the introduction region (e.g., position 50A) may be smaller than cross-sectional area of downstream fluid passage 32 at downstream pipe 52 (e.g., position 52A). The cross-sectional area at the introduction region may be smaller because of the "plume effect" (see reference numeral 59 in FIG. 2) that is manifested as the fluid exits the choke outlet and becomes rapidly expanded due to the reduction in pressure effected by the choke 26. In any case, the cross-sectional area of downstream fluid passage 32 at the introduction region (e.g., position 50A) may be larger than the cross-sectional area of upstream fluid passage 24 (e.g., position 34). The sizing of the cross-sectional areas at the in introduction region (e.g., position 50A) and at downstream pipe 52 (e.g., position 52A) will be explained in detail below.

Figure 3:
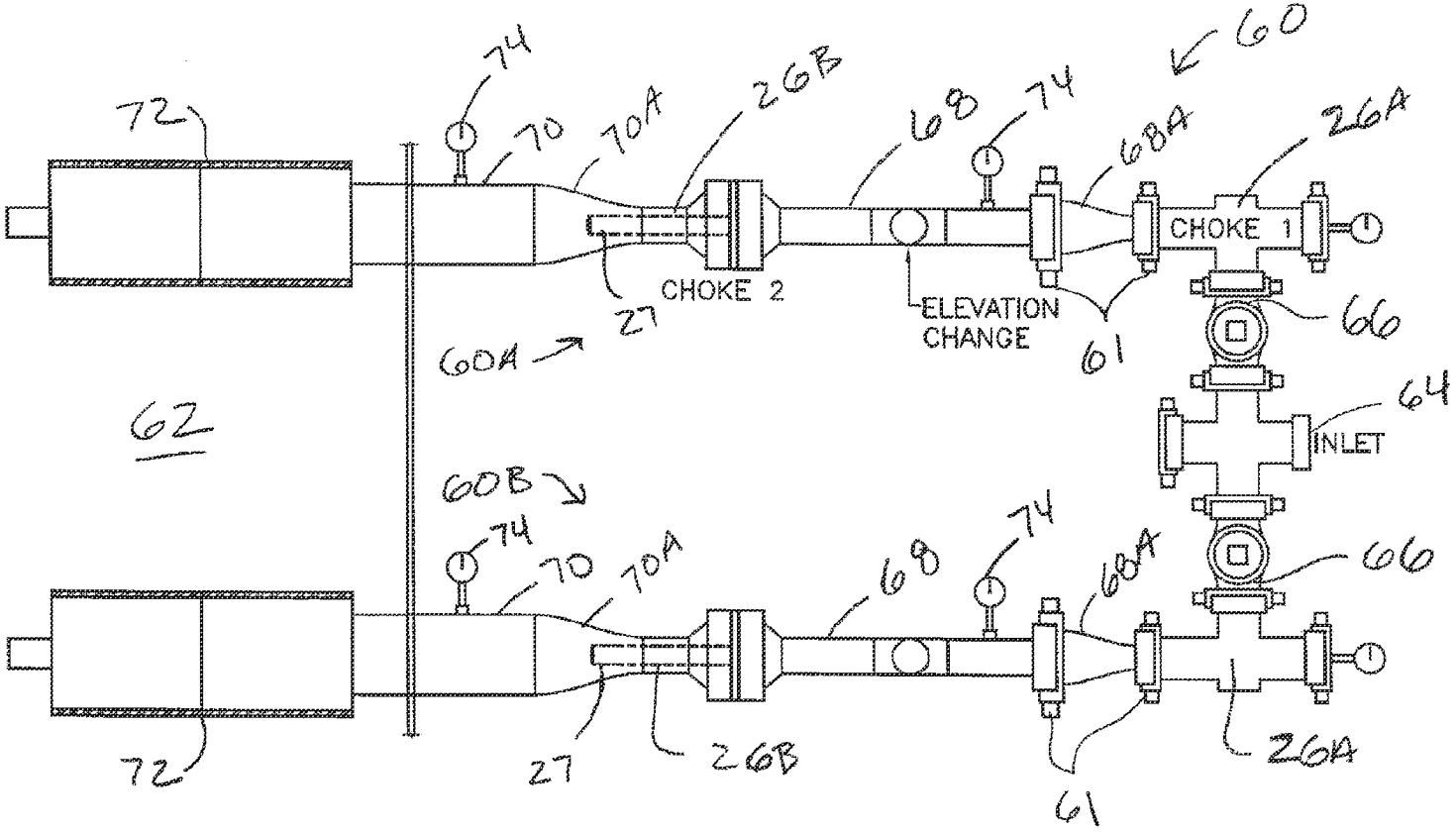
FIG. 3 is a top plan view of a manifold comprising the fluid conducting apparatus of FIG. 2.

FIG. 3 is a top plan view of a plurality of chokes 26 installed in exemplary manifold 60. Manifold 60 may be used for conducting well-related fluid(s) in container (tank) 62 during one or more well operations associated with hydraulic fracturing. For example, manifold 60 may receive pressurized fluid(s) via one or more inlets 64 from a hydrocarbon well (not shown). Manifold inlet 64 may split the flow of fluid(s) into a plurality of branches 60A, 60B of manifold 60 for delivery into container 62. Each of branches 60A, 60B may comprise one or more chokes 26 for reducing the pressure of fluid(s) prior to delivering the fluid(s) to container 62, which may be at atmospheric pressure.

Each branch 60A, 60B may be configured similarly. The plurality of chokes 26A, 26B may be used to cause stepwise pressure reductions in well-related fluid(s) prior to delivery to tank 62. Accordingly, two or more chokes 26A, 26B may be coupled in serial flow communication. For example, branch 60A may comprise first conduit 66 for receiving well-related fluid from manifold inlet 64 and conduct the well-related fluid(s) to first choke 26A. Second conduit 68 may receive the well-related fluid from first choke 26A and conduct the well-related fluid(s) to second choke 26A. Second conduit 68 may comprise adaptor 68A for interfacing with first choke 26A. Third conduit 70 may receive the well related fluid(s) from second choke 26B and conduct the well-related fluid(s) to tank 62. Third conduit 70 may comprise adaptor 70A for interfacing with second choke 26B. Third conduit 70 may have a cross-sectional area that is larger than a cross-sectional area of second conduit 68 to permit expansion of well-related fluid(s) following the pressure reduction caused by second choke 26B. Similarly, the cross-sectional area of second conduit 68 may be larger than the cross-sectional area of first conduit 66 to permit expansion of well-related fluid(s) following the pressure reduction caused by second choke 26B. As will be explained further below, the progressively larger cross-sectional areas of conduits 68 and 70 may be sized to prevent the average velocity of the well-related fluid(s) from exceeding a threshold average fluid velocity selected to mitigate erosion of conduits 68 and 70.

Third conduits 70 of each branch 60A and 60B of manifolds 60 may each lead to one or more diffusers 72 disposed inside tank 62. Diffusers 72 may serve to diffuse the well-related fluid(s) as it/they is/are delivered to tank 62. Diffusers 72 may comprise an elongated conduit extending inside tank 62 and comprising a plurality of openings through which the well-related fluid(s) may exit. Manifold 60 may also comprise pressure gauges 74 that may be used to monitor fluid pressures in second conduit 68 and/or third conduit 70 (i.e., downstream from first choke 26A and/or downstream from second choke 26B).

Figure 4:
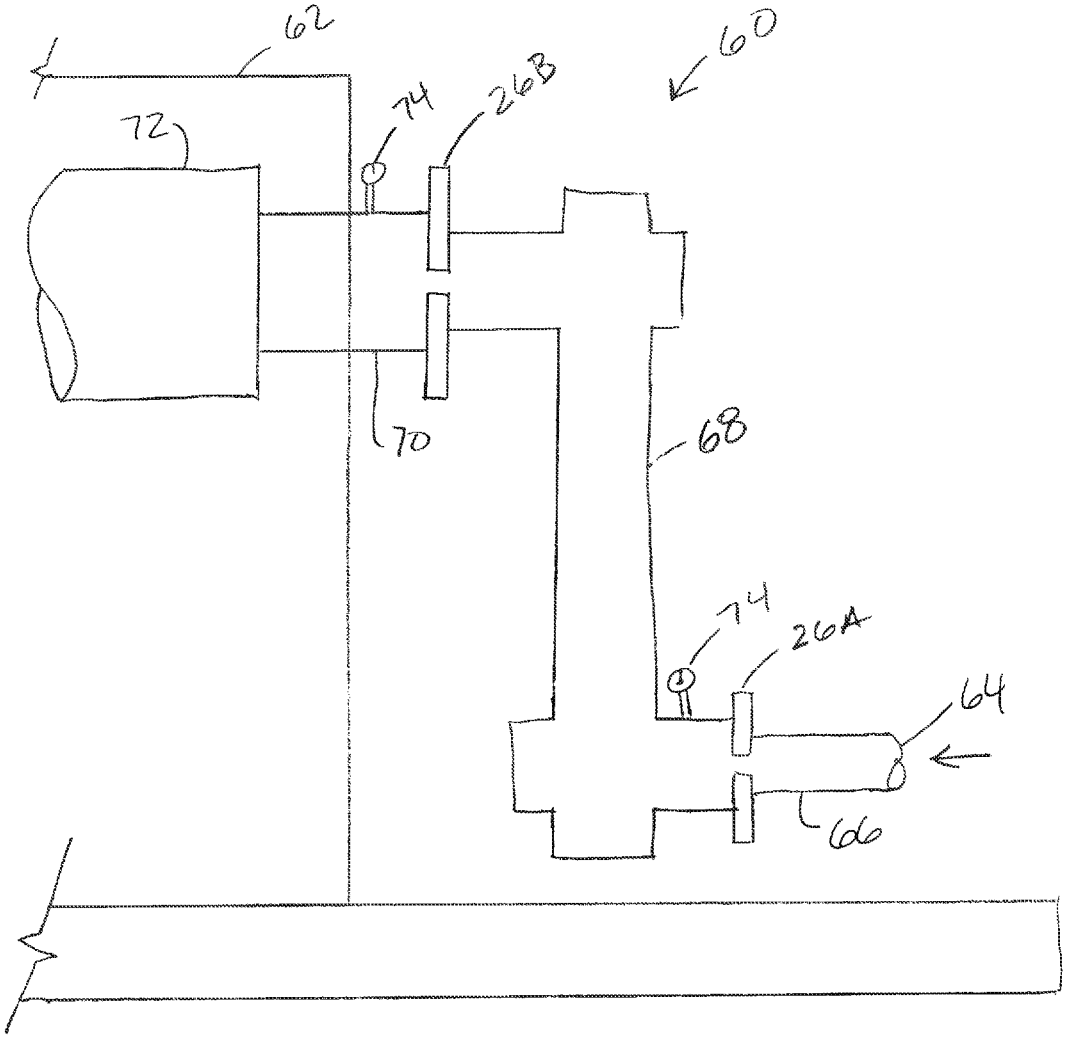
FIG. 4 is a schematic front elevation view of the manifold of FIG. 3.

FIG. 4 is a schematic front elevation view of the manifold of FIG. 3. It is noted that adaptors 68A and 70A shown in FIG. 3 are omitted in FIG. 4 and that chokes 26A, 26B are shown schematically as plate-type chokes for illustration purposes only. One skilled in the relevant arts will understand that other types of chokes, including bean-type chokes, could also be suitable for use in manifold 60.

Figure 5:
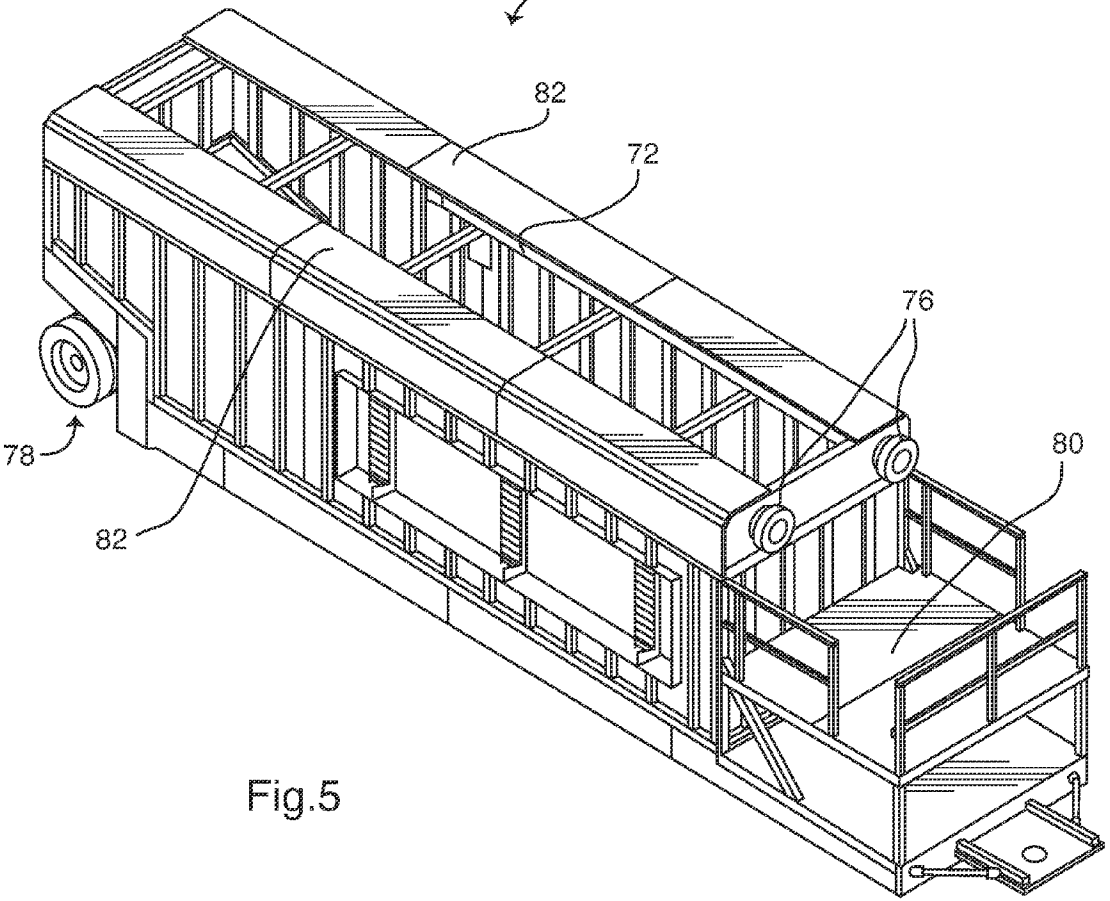
FIG. 5 is an axonometric view of a container for storing well-related fluid.

FIG. 5 is an axonometric view of an exemplary container (tank) 62 for storing well-related fluid(s). Container 62 may comprise container inlets 76 to which each branch 60A, 60B of manifold 60 may be coupled for delivery of well-related fluid(s) from third conduits 70 into diffusers 72 located in container 62. Accordingly, manifold 60 may be installed for fluid communication with container 62 during flow back operations. For example, manifold may remain installed on container 62 even during transport of container 62 so that it does not have to be uninstalled and re-installed between operations.

Container 62 may have rear axle 78 which may allow container 62 to be moved by a fifth wheel tractor truck. Container 62 may have platform 80 to support operators and that may facilitate the coupling of manifold 60 to container 62 and also the monitoring of pressure gauges 74 during operation. Container 62 may also have splash guards 82 disposed above diffusers 72 to substantially prevent well-related fluid(s) from being directed upward from diffusers 72 and out of container 62 during operation.

As mentioned above, the well-related fluids that are handled during some well applications may be highly pressurized (e.g., 10 ksi) and may comprise multiple phases including a gases, liquids and solid particles (e.g. sand, proppants) that may be abrasive. Accordingly, such fluids may be at least partially compressible at least due to the presence of a gaseous phase. During some operations where the multiphase, pressurized well-related fluid(s) flow(s) back from the well and must be stored in container 42 that is at atmospheric pressure, the pressure of the well-related fluid(s) must be reduced significantly before it/they are delivered to container 62. The reduction in pressure and the delivery of such well-related fluids may be achieved using apparatus and devices described herein.

For example, through the appropriate sizing of chokes 26A and 26B and also the appropriate sizing of second conduits 68 and third conduits 70, the average velocity of well-related fluid(s) flowing through manifold 60 may be kept to levels that do not result in excessive erosion. For example, the proper sizing of the above fluid handling components may be used to keep the average velocity of the well-related fluid(s) below a threshold average velocity selected to mitigate erosion.

In some applications, fluid composition and fluid handling equipment (e.g., piping, valves . . . etc.) the threshold average velocity selected may be about 120 feet/second. Accordingly the threshold average velocity may be determined experimentally based on the specific application, operating conditions and acceptable rates or erosion.

The sizing of fluid handling components will be explained in relation to FIG. 2 but it is understood that the teachings presented below could also relate to chokes 26A and 26B shown in FIG. 3. The sizing of components in fluid conducting apparatus 20 may be done to strategically decrease the pressure of the well-related fluid(s) and also increase the flow area for the well-related fluid(s) to occupy. Because gas expands when its pressure is reduced, the gas must occupy a larger volume a static state. In the case of a gas is flowing down a conduit of a constant cross-sectional area, a drop in pressure at particular point along the conduit will cause the gas to expand and consequently the velocity of the gas will increase downstream from the point of pressure drop (if no larger cross-sectional area is provided). The expansion of an ideal gas may be linear in accordance with the ideal gas law (e.g. Boyle's law) referred above, so that, for example, a gas at 10 ksi (absolute pressure) occupying a volume V1 will require double the volume V1 if the pressure of the gas is reduced to 5 ksi (absolute pressure). In the case of the gas flowing inside the conduit of constant cross-sectional area, this pressure drop will cause the average velocity of the gas in the conduit to double downstream of the pressure drop.

Even though the well-related fluid(s) conducted by fluid conducting apparatus 20 may not be entirely gaseous and may not be entirely compressible, the sizing of fluid conducting downstream conduit 30 may be determined based on a conservative estimation of the portion of well-related fluid(s) that may be compressible. Alternatively, it may be appropriate to assume, for the purpose of sizing downstream conduit 30, that the entirety of the well-related fluid(s) is compressible in accordance with Boyle's law. This assumption may provide a conservative representation of the potential fluid expansion that may occur based on a given flow rate of multi-phase well-related fluid(s) in downstream conduit 30. For example, using such assumption, if a portion of the well-related fluid is incompressible, then the expansion of the well-related fluid(s) will be less than the expansion capacity provided by downstream conduit 30 and hence the average velocity of the well-related fluid(s) downstream of choke 26 will still be below the threshold average fluid velocity selected to mitigate erosion.

Table 1 below illustrates exemplary numerical values of fluid velocities and pressures associated with reference to FIG. 2.

TABLE 1

| Parameter | Numerical Value |
|---|---|
| Pressure in upstream passage 24 | 3000 psi |
| Volumetric flow rate through upstream passage 24 | 2.2 $ft^3$/sec |
| Internal diameter of upstream passage 24 (circular pipe) | 0.167 ft (2 inches) |
| Cross-sectional area of upstream passage 24 | 0.022 $ft^2$ |
| Average fluid velocity through upstream passage 24 | 100 ft/sec |
| Pressure drop across choke 26 | 1500 psi |
| Pressure in downstream passage 32 | 1500 psi |
| Volumetric flow rate through downstream passage 32 (calculated using Boyle's law assuming that the entirety of the fluid is compressible and behaves as an ideal gas) | 4.4 $ft^3$/sec |
| Threshold average velocity to mitigate erosion of downstream passage 32 | 120 ft/sec |
| Minimum cross-sectional area of downstream passage 32 required to not exceed threshold average velocity | 0.0367 $ft^2$ |
| Minimum diameter of downstream passage 32 required to not exceed threshold average velocity (circular pipe) | 0.216 ft (2.6 inches) |

While the minimum cross-sectional area calculated above may be required to keep the average velocity of the expanded well-related fluid(s) below the threshold average velocity selected to mitigate erosion, it may not be necessary that the fully enlarged cross-sectional area be located immediately downstream of choke outlet 40 (e.g., at position 50A) due to entrance effects of the fluid(s) flowing out of choke 26. For example, it may be desirable to have the fully expanded cross-sectional area of downstream passage 32 disposed at choke outlet 40, but due to pluming of the fluid(s) as the fluid(s) exit(s) choke passage 28, there may be an allowable distance between the fully expanded cross-sectional area and choke outlet 40. As the well-related fluid(s) exit(s) choke outlet 40, it/they may substantially continue to flow relatively along the longitudinal direction of choke passage 28 for some distance after choke outlet 40 before significant expansion and diffusion of the fluids. This distance may vary depending on the operation conditions but may be less than one (1) inch, for example, during some well-related flow back operations. For example, due at least partly to choke outlet 40 being positioned relatively centrally to downstream passage 32, the velocity of the fluid(s) through downstream passage 32 near choke outlet 40 may be relative higher in a central region of downstream passage 32 and may not pose significant risk of erosion of the internal walls of downstream conduit 30. Accordingly, some distance from choke outlet 40 may be required for the velocity profile of well-related fluid(s) through downstream passage 32 to become more uniform.

Nevertheless, it may be desirable to provide at least a partially expanded cross-sectional area of downstream passage 32. Accordingly, cross-sectional area of downstream passage 32 taken at position 50A may be greater than cross-sectional area of upstream passage 24 taken at position 34. For example, it may be acceptable in some cases to use adaptor 50 to transition to the fully expanded cross-sectional area of downstream passage 32 taken at position 52A at have choke outlet 40 positioned at a point along adaptor 50. The fully expanded cross-sectional area of downstream passage 32 may be disposed immediately downstream of (e.g., at) choke outlet 40 or, alternatively, due to the entrance effects (e.g., pluming) of the well-related fluids into downstream passage 32, it may be acceptable to have the fully expanded cross-sectional area of downstream passage 32 disposed substantially at (i.e., at some allowable downstream distance from) choke outlet 40. In other words, the fully expanded cross-section area of downstream passage 32 may be disposed at some allowable distance that takes into consideration of the entrance effects of the well-related fluid(s) and does not pose an increased risk of erosion of downstream conduit 30.

As mentioned above, a plurality of chokes 26 may be coupled in serial flow communication to achieve stepwise pressure drops of well-related fluid(s) during flow back operations prior to delivering the well-related fluid(s) to container 62, which may be at atmospheric pressure. The sizing of fluid handling components for achieving stepwise pressure drops is illustrated through the numerical examples included in Table 2 below and in relation to FIG. 3. The stepwise pressure reductions may be done to limit the average velocity of well-related fluid(s) through individual chokes 26 and therefore reduce the risk of erosion of choke members 27. Since choke members 27 may be made of materials having a greater wear resistance and/or hardness than that of conduits 22 and 30, a different (e.g., higher) threshold average velocity may be selected for chokes 26. Accordingly, methods presented herein may also be used to select choke sizes to mitigate erosion of chokes 26A and 26B.

TABLE 2

| Parameter | Numerical Value |
|---|---|
| Pressure at inlet 64 | 3000 psi |
| Volumetric flow rate through first conduit 66 | 0.167 $ft^3$/sec |
| Internal diameter of first conduit 66 (circular pipe) | 0.133 ft (1.6 inches) |
| Internal cross-sectional area of first conduit 66 | 0.0139 $ft^2$ |
| Average fluid velocity through first conduit 66 | 12.04 ft/sec |
| Pressure drop across choke 26A | 1500 psi |
| Pressure in second conduit 68 | 1500 psi |
| Volumetric flow rate through second conduit 68 (calculated using Boyle's law assuming that the entirety of the fluid is compressible and behaves as an ideal gas) | 0.335 $ft^3$/sec |

TABLE 2-continued

| Parameter | Numerical Value |
|---|---|
| Average fluid velocity through second conduit 68 | 5.99 ft/sec |
| Internal cross-sectional area of second conduit 68 | 0.056 $ft^2$ |
| Internal diameter of second conduit 68 (circular pipe) | 0.267 ft (3.2 inches) |
| Pressure drop across choke 26B | 1475 psi |
| Pressure in third conduit 70 | 25 psi |
| Volumetric flow rate through third conduit 70 (calculated using Boyle's law assuming that the entirety of the fluid is compressible and behaves as an ideal gas) | 12.83 $ft^3$/sec |
| Average fluid velocity through third conduit 70 | 101.87 ft/sec |
| Internal cross-sectional area of third conduit 70 | 0.126 $ft^2$ |
| Internal diameter of third conduit 70 (circular pipe) | 0.4 ft (4.8 inches) |

Choke passage 28 may have a cross-sectional area that is smaller than the cross-sectional area of upstream passage 24. Choke passage 28 may also have a cross-sectional area that is smaller than the cross-sectional area of downstream passage 32. The cross-sectional area of choke passage 28 may be selected to provide a desired pressure drop in well-related fluid(s) being conducted through fluid conducting apparatus 20. For example, the cross-sectional area of choke passage 28 may be selected to provide a friction loss coefficient ($K_f$) of at least fifteen (15). For example, the $K_f$ is at least twenty (20). As a further example, the $K_f$ is at least twenty (20). Typically, a larger pressure differential required results in a smaller the choke diameter being required for a specific fluid (e.g., gas) flow rate. The internal diameter of choke(s) 26A, 26B (e.g., the internal diameter of choke passage 28) can be calculated and pressures (upstream and downstream) predicted for desired pressure drops.

Figure 6:
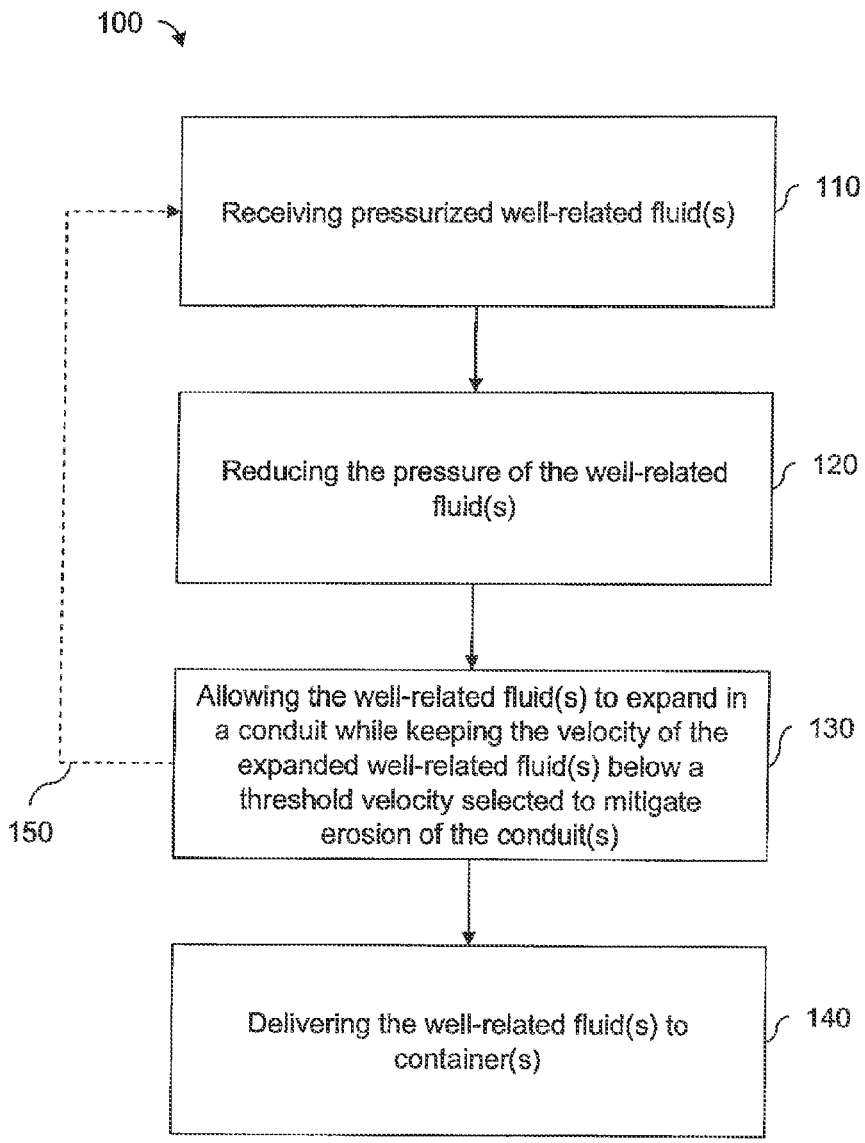
FIG. 6 is a flow chart illustrating a method in accordance with the present disclosure.

FIG. 6 shows a flow chart illustrating exemplary method 100 in accordance with one aspect of the present disclosure. For example, method 100 may comprise: receiving pressurized well-related fluid(s) (see block 110); reducing the pressure of the well-related fluid(s) (see block 120); Allowing the well-related fluid(s) to expand in a conduit while keeping the velocity of the expanded well-related fluid(s) below a threshold velocity selected to mitigate erosion of the conduit (see block 130); and delivering the well-related fluid(s) to a container (see block 140). As mentioned above, the pressure reduction may be done stepwise used a plurality of chokes 26A and 26B connected in serial flow communication. Accordingly, blocks 110, 120 and 130 may be repeated as desired to achieve the desired overall pressure reduction in the desired number of steps (e.g., stages) as shown by arrow 150.

As explained above, the expansion of the well-related fluid(s) may be done by providing downstream passage 32 of expanded cross-sectional area at or substantially at, choke outlet 40 for the purpose of limiting the average velocity of the well-related fluid(s) below at threshold selected to mitigate erosion. According to the numerical examples provided above, the downstream cross-sectional area may be sized based on: a predetermined flow rate of well-related fluid(s) through downstream fluid passage 32; a predetermined pressure of the well-related fluid(s) in downstream fluid passage 32; a predetermined portion of the well-related fluid(s) being compressible and a threshold average fluid velocity through downstream fluid passage(s) selected to mitigate erosion. The threshold average velocity may be selected so that fluid handling equipment will not be rapidly eroded and will provide an acceptable level of service for and acceptable period of time. For example, in well-related operations involving pressurized flow back fluid(s), such threshold average velocity may be around 120 ft/sec.

The above description is meant to be exemplary only, and one skilled in the relevant arts will recognize that changes may be made to the embodiments described without departing from the scope of the invention disclosed. For example, the blocks and/or operations in the flowcharts and drawings described herein are for purposes of example only. There may be many variations to these blocks and/or operations without departing from the teachings of the present disclosure. For instance, the blocks may be performed in a differing order, or blocks may be added, deleted, or modified. The present disclosure may be embodied in other specific forms without departing from the subject matter of the claims. Also, one skilled in the relevant arts will appreciate that while the systems, apparatus and assemblies disclosed and shown herein may comprise a specific number of elements/components, the systems, apparatus and assemblies could be modified to include additional or fewer of such elements/components. For example, while any of the elements/components disclosed may be referenced as being singular, it is understood that the embodiments disclosed herein could be modified to include a plurality of such elements/components. The present disclosure is also intended to cover and embrace all suitable changes in technology. Modifications which fall within the scope of the present invention will be apparent to those skilled in the art, in light of a review of this disclosure, and such modifications are intended to fall within the appended claims.

What is claimed is:

1. An apparatus for conducting well-related fluid, the apparatus comprising:

an upstream conduit including an upstream fluid passage for receiving and conducting well-related fluid, the upstream fluid passage being defined by a fluid passage-defining upstream conduit surface material and having an upstream cross-sectional area at an upstream location;

a choke member including a choke fluid passage in fluid communication with the upstream fluid passage, the choke fluid passage being defined by a fluid passage-defining choke member surface material, the choke fluid passage having a choke inlet, for receiving the well-related fluid from the upstream fluid passage, and a choke outlet, the choke fluid passage having a minimum choke cross-sectional area that is smaller than the upstream cross-sectional area; and a downstream conduit including a downstream fluid passage in fluid communication with the upstream fluid passage via the choke fluid passage and configured to receive the well-related fluid from the choke outlet and conduct the well-related fluid, the downstream fluid passage being defined by a fluid passage-defining downstream conduit surface material and having a downstream cross-sectional area at, or substantially at the choke outlet, wherein the downstream cross-sectional area is larger than the upstream cross-sectional area;

wherein the wear resistance of the fluid passage-defining choke member surface material is greater than the wear resistance of the fluid passage-defining downstream conduit surface material.

2. The apparatus as defined in claim 1, wherein the downstream cross-sectional area is sized based on: a predetermined flow rate of well-related fluid through the downstream fluid passage; a predetermined pressure of the well-related fluid in the downstream fluid passage; a predetermined portion of the well-related fluid being compressible and a threshold average fluid velocity through the downstream fluid passage selected to mitigate erosion.

3. The apparatus as defined in claim 2, wherein the threshold average fluid velocity is about 120 feet/second.

4. The apparatus as defined in claim 1, wherein the downstream cross-sectional area is sized based on the expansion of the well-related fluid in accordance with Boyle's law.

5. The apparatus as defined in claim 1, wherein the choke member is removably installed to establish fluid communication between the upstream fluid passage and the downstream fluid passage.

6. The apparatus as defined in claim 1, wherein the downstream cross-sectional area progressively increases for at least a portion of the downstream fluid passage from the choke outlet along a downstream direction of the downstream fluid passage.

7. The apparatus as defined in claim 1, wherein the downstream conduit comprises a pipe and an adaptor establishing fluid communication between the pipe and the choke fluid passage, the adaptor having a cross-sectional area that increases along a downstream direction.

8. The apparatus as defined in claim 1, wherein the ratio of the downstream cross-sectional area over the upstream cross-sectional area is proportional to a predetermined reduction of pressure of the well-related fluid caused by the choke fluid passage.

9. An assembly for conducting well-related fluid, the assembly comprising:

an upstream conduit including an upstream fluid passage defined therein for receiving and conducting well-related fluid, the upstream fluid passage having an upstream cross-sectional area at an upstream location;

a removably installed choke member including a choke fluid passage defined therein, the choke fluid passage having a choke inlet, for receiving the well-related fluid from the upstream fluid passage, and a choke outlet, the choke fluid passage having a minimum choke cross-sectional area that is smaller than the upstream cross-sectional area; and a downstream conduit including a downstream fluid passage defined therein in fluid communication with the upstream fluid passage via the choke fluid passage and configured to receive the well-related fluid from the choke outlet and conduct the well-related fluid, the downstream fluid passage having a downstream cross-sectional area at, or substantially at, the choke outlet that is larger than the upstream cross-sectional area;

wherein the choke member comprises a flow bean.

10. An assembly for conducting well-related fluid, the assembly comprising:

an upstream conduit including an upstream fluid passage defined therein for receiving and conducting well-related fluid, the upstream fluid passage having an upstream cross-sectional area at an upstream location;

a removably installed choke member including a choke fluid passage defined therein, the choke fluid passage having a choke inlet, for receiving the well-related fluid from the upstream fluid passage, and a choke outlet, the choke fluid passage having a minimum choke cross-sectional area that is smaller than the upstream cross-sectional area; and a downstream conduit including a downstream fluid passage defined therein in fluid communication with the upstream fluid passage via the choke fluid passage and configured to receive the well-related fluid from the choke outlet and conduct the well-related fluid, the downstream fluid passage having a downstream cross-sectional area at, or substantially at, the choke outlet that is larger than the upstream cross-sectional area;

wherein the choke fluid passage is defined by a fluid passage-defining choke member surface material, and wherein the downstream fluid passage is defined by a fluid passage-defining downstream conduit surface material, wherein a wear resistance of the fluid passage-defining choke member surface material is greater than a wear resistance of the fluid passage-defining downstream conduit surface material.

11. An assembly for conducting well-related fluid, the assembly comprising:

an upstream conduit including an upstream fluid passage defined therein for receiving and conducting well-related fluid, the upstream fluid passage having an upstream cross-sectional area at an upstream location;

a removably installed choke member including a choke fluid passage defined therein, the choke fluid passage having a choke inlet, for receiving the well-related fluid from the upstream fluid passage, and a choke outlet, the choke fluid passage having a minimum choke cross-sectional area that is smaller than the upstream cross-sectional area; and a downstream conduit including a downstream fluid passage defined therein in fluid communication with the upstream fluid passage via the choke fluid passage and configured to receive the well-related fluid from the choke outlet and conduct the well-related fluid, the downstream fluid passage having a downstream cross-sectional area at, or substantially at, the choke outlet that is larger than the upstream cross-sectional area;

wherein the downstream cross-sectional area progressively increases for at least a portion of the downstream fluid passage from the choke outlet along a downstream direction of the downstream fluid passage.

12. An assembly for conducting well-related fluid, the assembly comprising:

a choke member including a choke fluid passage defined therein, the choke fluid passage having a choke inlet, for receiving well-related fluid from an upstream fluid passage, and a choke outlet, the choke fluid passage having a minimum choke cross-sectional area;

an upstream pipe connected to the choke member, upstream of the choke member, the upstream pipe including the upstream fluid passage defined therein for receiving and conducting the well-related fluid, the upstream fluid passage having an upstream cross-sectional area at an upstream location;

an expander connected to the choke member, downstream of the choke member; and a downstream pipe connected to the choke member, downstream of the choke member, via the expander, the downstream pipe including a downstream fluid passage defined therein in fluid communication with the upstream fluid passage via the choke fluid passage, the downstream fluid passage being configured to receive the well-related fluid from the choke outlet and conduct the well-related fluid, the downstream fluid passage having a downstream cross-sectional area at a downstream location that is larger than the upstream cross-sectional area.

13. The assembly as defined in claim 12, wherein the upstream cross-sectional area is the cross-sectional area, within the upstream fluid passage, disposed at, or substantially at, the choke inlet.

14. The assembly as defined in claim 12, wherein the upstream cross-sectional area is the maximum cross-sectional area of the upstream fluid passage.

15. The assembly as defined in claim 12, wherein the downstream cross-sectional area is larger than the upstream cross-sectional area by a factor of at least 1.1.

16. The assembly as defined in claim 12, wherein the downstream cross-sectional area is larger than the upstream cross-sectional area by a factor of at least 1.25.

* * * * *